US005179741A

United States Patent [19]

Book

[11] Patent Number: 5,179,741

[45] Date of Patent: Jan. 19, 1993

[54] EASILY STORED INFANT PILLOW AND BLANKET

[75] Inventor: Steven C. Book, North Hollywood, Calif.

[73] Assignee: Auto-Shade, Inc., North Hollywood, Calif.

[21] Appl. No.: 757,079

[22] Filed: Sep. 10, 1991

[51] Int. Cl.[5] ..... A47G 9/00

[52] U.S. Cl. ..... 5/417; 5/636; 190/1; 297/397; 383/4

[58] Field of Search ..... 5/417–420, 5/482, 485, 500, 502, 636; 190/1, 2; 383/4; 297/391, 394, 397

[56] References Cited

U.S. PATENT DOCUMENTS

| | | | |
|---|---|---|---|
| 100,014 | 2/1870 | Cook | 297/394 |
| 2,183,418 | 12/1939 | Williams | 5/420 |
| 3,241,161 | 3/1966 | Dashosh | 5/490 |
| 3,344,010 | 3/1944 | Walsh | 5/418 |
| 3,477,552 | 11/1969 | Goldman | 5/420 |
| 3,530,516 | 9/1970 | Marquette | 5/486 |
| 4,188,988 | 2/1980 | Agyagos | 5/417 |
| 4,447,922 | 5/1984 | Brochu | 297/391 |
| 5,048,975 | 9/1991 | Holbrook | 190/2 |

FOREIGN PATENT DOCUMENTS

| | | | |
|---|---|---|---|
| 819449 | 10/1951 | Fed. Rep. of Germany | 190/2 |
| 688307 | 3/1953 | United Kingdom | 5/417 |
| 1264919 | 2/1972 | United Kingdom | 383/4 |

*Primary Examiner*—Alexander Grosz

*Attorney, Agent, or Firm*—Blakely, Sokoloff, Taylor & Zafman

[57] ABSTRACT

An improved easily stored combination pillow and infant blanket that can be used as a pillow when folded and secured by a zipper or when not folded and secured can be used as an infant size blanket. The blanket folds into itself to minimize any sharp edges on the blanket. Straps are provided to attach the pillow to another surface to keep the pillow in place. When unfolded as a blanket the zipper is only on one side such that the zipper edge does not detract from the use as a soft blanket. When folded in the pillow configuration a strap can be attached for carrying and for ease of use as a carrying bag when objects are placed within the folds of the pillow-blanket for transport.

5 Claims, 1 Drawing Sheet

EASILY STORED INFANT PILLOW AND BLANKET

1. FIELD OF INVENTION

The instant invention relates to an improved pillow and blanket combination for use with infants that may be easily stored.

2. DESCRIPTION OF PRIOR ART

There are inventions that are similar to the improved easily stored pillow and blanket, but they are not convenient to use, are more cumbersome, utilize the outer peripheral edge for attachment or are too bulky to use as a neck rest.

SUMMARY OF THE INVENTION

The instant invention provides a convenient pillow or infant blanket as required by the user. The device is both a small quilted blanket, and when folded and secured, a neck pillow. The device has an attachment strap to secure the pillow to another surface such as an automobile head rest. Since the device is easily opened from the side of the pillow, when folded as a pillow, it can also serve as a temporary storage bag. In accordance with the description presented herein, other objects of the invention will become apparent when the drawings and specifications herein are reviewed.

DESCRIPTION OF THE PREFERRED EMBODIMENT

Figure 1:
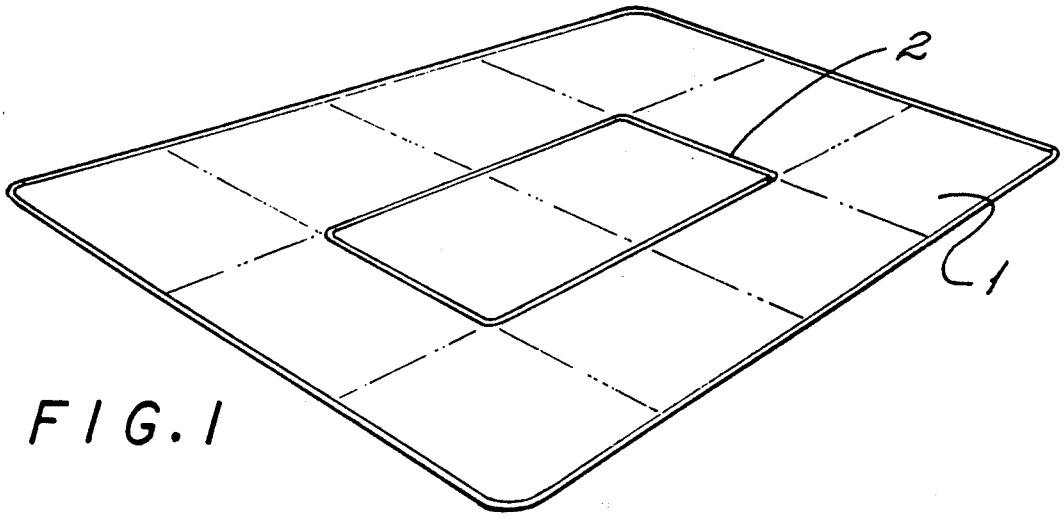
FIG. 1 is an isometric view of the top of the combination pillow and blanket when opened as a blanket.
Figure 2:
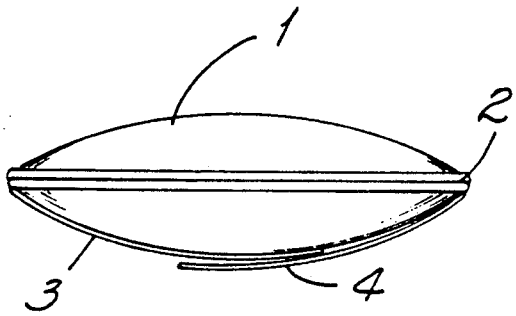
FIG. 2 is a side view of the combination pillow and blanket when closed as a pillow.
Figure 3:
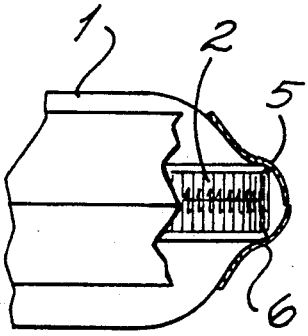
FIG. 3 is a bottom view of the combination pillow and blanket when closed as a pillow.
Figure 4:
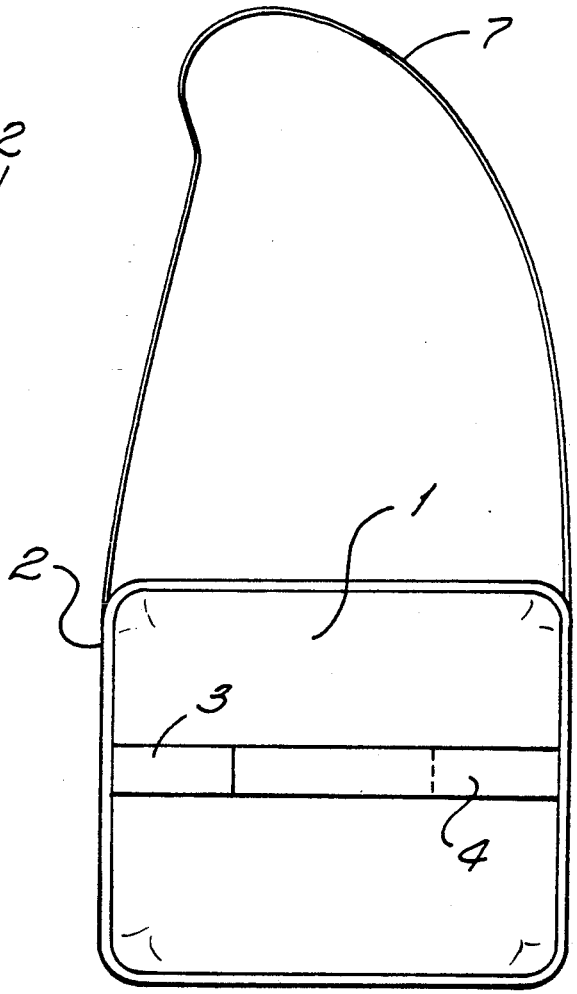
FIG. 4 is a view of the edge of the combination pillow and blanket when closed as a pillow.

Referring to FIGS. 1 through 4, the combination pillow and blanket is illustrated. The blanket (1) may be made in any manner. The blanket is of a size to cover an infant or the chest and lap of an adult. A size of approximately thirty by forty inches has been found to be satisfactory and to provide the correct ratio for blanket and pillow combination. Although other materials may be used, the preferred embodiment is covered with a durable soft blend of polyester and cotton fabric that is easily washable. For best cushioning either a feather filling or polyester fiber may be used. Attached to the interior portion of the blanket (1) is an attachment means that when folded in half attaches to itself. As shown in the preferred embodiment the attachment means is a zipper (2) attached in the shape of a rectangle. In one direction the blanket portion not enclosed by the attachment means is folded into the side of the blanket opposite the side of the attachment means. In the other direction each side is folded into the same side of the attachment means as the side being folded. When completely folded the two sections are further folded and each half of the attachment means is placed next to the mating side of the attachment means. The zipper (2) may be engaged and the folded blanket sealed to become a pillow.

Longitudinally as part of two halves of the zipper (2) are two strips of material forming an upper and lower zipper cover (5,6) attached to the edge of the zipper (2) that lays over the exterior of the zipper (2). When zipped the upper and lower zipper cover (5,6) protect the zipper (2) and user. The pillow is approximately ten inches by twelve inches and may be used as a neck pillow.

A strap (7) is attached by snaps or hook and loop means to the folded pillow configuration for ease of carrying the pillow and for use as a carrying bag.

Right and left securing strap (3,4) are attached to the edge of the preferred embodiment to allow attaching the pillow to a head rest or other support surface. In the preferred embodiment elastic straps using VELCRO or similar hook and loop material are used to secure the straps to each other. The straps are two piece as some headrests have a marked curvature which requires the pillow to be attached vertically to the headrest rather than horizontally and the straps may be placed between the posts of the headrest.

I claim:

1. A blanket that can be folded into a pillow, comprising:

a fabric sheet having a first surface and a second surface, said fabric sheet being adapted to be folded into a pillow having three unattached edges; and zipper attached directly to said first surface of said fabric sheet for fastening together said unattached edges of said fabric sheet when said fabric sheet is folded, said zipper being arranged generally centrally on said blanket in a rectangular pattern.

2. The blanket as recited in claim 1, further comprising a fabric strip adjacent to said zipper and attached to said first surface of said fabric sheet.

3. The blanket as recited in claim 2, further comprising a first strap and a second strap both attached to said first surface of said fabric sheet.

4. The blanket as recited in claim 3, wherein said straps have attachment means for attaching said first strap to said second strap.

5. The blanket as recited in claim 4, wherein said attachment means is hook and loop material.

* * * * *